US008574040B2

(12) United States Patent
Chung-Fat et al.

(10) Patent No.: US 8,574,040 B2
(45) Date of Patent: Nov. 5, 2013

(54) MULTI-AIR AQUA RESERVOIR MOIST SANDING SYSTEM

(75) Inventors: Mervyn Chung-Fat, Neuilly (FR); Biagio P. Pellegrino, Watervliet, NY (US); Vivien Luttenschlager, Paris (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 789 days.

(21) Appl. No.: 12/637,483

(22) Filed: Dec. 14, 2009

(65) Prior Publication Data

US 2010/0167630 A1 Jul. 1, 2010

Related U.S. Application Data

(60) Provisional application No. 61/203,877, filed on Dec. 30, 2008.

(51) Int. Cl.
*B24D 11/00* (2006.01)

(52) U.S. Cl.
USPC ..... 451/527; 51/297; 451/533; 451/539

(58) Field of Classification Search
USPC ..... 51/296, 297, 298, 307; 451/526, 527, 451/533, 539
See application file for complete search history.

(56) References Cited

U.S. PATENT DOCUMENTS

| | | | | |
|---|---|---|---|---|
| 3,021,649 | A * | 2/1962 | Robbins | 451/534 |
| 4,355,489 | A | 10/1982 | Heyer et al. | |
| 4,490,948 | A | 1/1985 | Hanstein et al. | |
| 4,523,411 | A | 6/1985 | Freerks | |
| 4,714,644 | A * | 12/1987 | Rich | 428/136 |
| 4,922,665 | A | 5/1990 | Wanatowicz | |
| 5,152,809 | A | 10/1992 | Mattesky | |
| 5,417,726 | A | 5/1995 | Stout et al. | |
| 5,419,087 | A | 5/1995 | Haddy | |
| 5,505,747 | A | 4/1996 | Chesley et al. | |

(Continued)

FOREIGN PATENT DOCUMENTS

| | | |
|---|---|---|
| EP | 0 549 202 A1 | 6/1993 |
| GB | 916031 | 1/1963 |
| JP | 2003164404 A | 6/2003 |

OTHER PUBLICATIONS

Notification of Transmittal of the International Search Report and the Written Opinion of the International Search Authority, or the Declaration dated Jun. 30, 2010 for PCT/US2009/067915.

(Continued)

*Primary Examiner* — Timothy V Eley
(74) *Attorney, Agent, or Firm* — Joseph P. Sullivan; Abel Law Group, LLP

(57) ABSTRACT

An abrasive disc includes a backing layer on a first major surface, a water-impermeable abrasive layer on a second major surface, and a water-absorbable, compressible, resilient, porous foam layer sandwiched in between the backing layer and the abrasive layer. The disc further includes a plurality of perforations. The disc is used to abrade a surface. Fluid is absorbed into the abrasive disc. The fluid is then released to the surface by compressing the abrasive disc against the surface in an abrading motion. The fluid is allowed to mix with and absorb surface swarf; and compression on the abrasive disc is released, reabsorbing the fluid and trapping swarf inside the disc.

7 Claims, 4 Drawing Sheets

(56) References Cited

U.S. PATENT DOCUMENTS

| | | | | |
|---|---|---|---|---|
| 5,512,010 | A | 4/1996 | Labad, Jr. | |
| 5,565,011 | A | 10/1996 | Follett et al. | |
| 5,573,619 | A | 11/1996 | Benedict et al. | |
| 5,582,541 | A | 12/1996 | Hutchins | |
| 5,700,302 | A | 12/1997 | Stoetzel et al. | |
| 5,957,605 | A | 9/1999 | Cohen et al. | |
| 6,024,634 | A | 2/2000 | Höglund et al. | |
| 6,132,301 | A | 10/2000 | Kaiser | |
| 6,797,023 | B2 | 9/2004 | Knapp et al. | |
| 7,338,355 | B2 | 3/2008 | Sanders, Jr. et al. | |
| 7,452,265 | B2 | 11/2008 | Rambosek et al. | |
| 7,628,829 | B2 | 12/2009 | Woo et al. | |
| 2002/0087167 | A1 | 7/2002 | Winitsky | |
| 2003/0003856 | A1 | 1/2003 | Swei | |
| 2004/0166788 | A1 * | 8/2004 | Travis | 451/359 |
| 2006/0148390 | A1 | 7/2006 | Woo et al. | |
| 2007/0028525 | A1 | 2/2007 | Woo et al. | |
| 2007/0212985 | A1 | 9/2007 | Boler, Jr. | |
| 2007/0243804 | A1 | 10/2007 | Peterson | |
| 2008/0229672 | A1 | 9/2008 | Woo et al. | |

OTHER PUBLICATIONS

PCT/US2009/067915: Notification Concerning Transmittal of International Preliminary Report on Patentability dated Jul. 14, 2011. Search Results, 22 pages.

3M Industrial Business, "Application Profile—Damp Hand Sanding of Primers and Electro-Coated Surfaces", Copyright 3M 2005, 3 pages.

3M Abrasive Systems, "Coated Abrasive Products—Damp Sanding", Apr. 2002, Copyright 3M 2002, 4 pages.

3M eStore, "3M Center Water Feed Disc Hand Pad Replacement Sponge," Feb. 21, 2008, 2 pages. <http://www.3mestore.com/3m-center-water-feed-disc-hand-pad-replacement-sponge.html>.

* cited by examiner

MULTI-AIR AQUA RESERVOIR MOIST SANDING SYSTEM

RELATED APPLICATION

This application claims the benefit of U.S. Provisional Application No. 61/203,877, filed on Dec. 30, 2008.

The entire teachings of the above application are incorporated herein by reference.

BACKGROUND OF THE INVENTION

Wet sanding is a process useful in abrading and removing surface defects and smoothing a variety of surfaces in preparation for finishing with a sealing and/or a protective finish, such as paint. Wet sanding is commonly used following automobile body repairs to smooth and prepare the automobile body for refinishing and repainting. Wet surface treatment prevents loading or clogging of the abrasive article, reduces heat build-up, and can even impart a particular attribute of the fluid used onto the surface being treated.

Typical wet sanding practices include using an abrasive disc with a special tool that delivers a continuous amount of fluid to the abrasive disc. Alternatively, the fluid is sprayed onto a work surface, such as an automotive panel or solid surface work table. In both approaches, fluid must steadily be resupplied to the area of being abraded. What is needed is an abrasive product that is suitable for wet sanding processes that requires little to no resupply of fluid throughout the abrading process.

SUMMARY OF THE INVENTION

In one aspect, the invention is directed to an abrasive disc having a backing layer at a first major surface, a water-impermeable abrasive layer at a second major surface, and a water-absorbable, compressible, resilient, porous foam layer sandwiched in between the backing layer and the abrasive layer. The disc further includes a plurality of perforations.

In another aspect, the invention is directed to a method of abrading a surface using the above described disc, including the steps of absorbing fluid into an abrasive disc, releasing the fluid through the abrasive disc by compressing the abrasive disc against the surface in an abrading motion, allowing the fluid to mix with and absorb surface swarf, and reabsorbing the fluid and trapping swarf inside the abrasive disc by releasing compression on the abrasive disc.

Thus provided is an abrasive product that is suitable for wet sanding processes that requires little to no resupplying of fluid throughout the abrading process. The perforated wet abrasive product sustains a longer useful product life than a continuous wet abrasive disc and produces an abraded surface that is smoother and more uniform. The abrasive product is particularly useful for abrading on composites or coatings where clogging can be problem during sanding process (e.g., paint repair, solid surface).

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
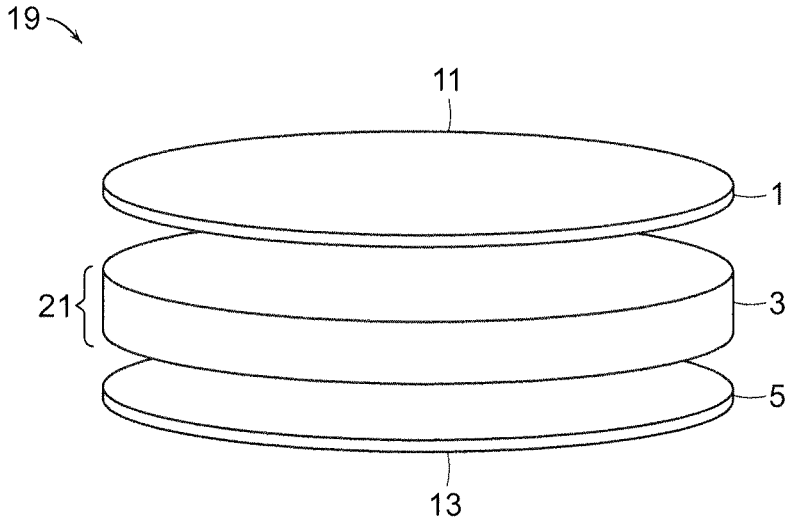
FIG. 1 is an exploded view of the layers of an abrasive disc as shown without perforations.

A description of example embodiments of the invention follows.

Abrasive articles of the present invention are typically circular discs, are but not limited to this particular shape. Although the abrasive article is termed a "disc" within this description and as shown in the drawings, the term as used herein means a relatively thin and flat object with two major surfaces, but need not be circular in shape.

The abrasive disc of the present invention includes a backing layer at a first major surface, a water-impermeable abrasive layer at a second major surface, and a water-absorbable, compressible, resilient, porous foam layer sandwiched in between the backing layer and the abrasive layer. The disc further includes a plurality of perforations. FIG. 1 is an exploded view of the various layers of one embodiment of the abrasive disc. For simplicity, the perforations of the disc are not shown. An outer surface of the backing layer 1 is exposed, providing a first major surface 11 of the abrasive disc. An outer surface of the abrasive layer 5 is also exposed, providing a second major surface 13 of the abrasive disc. Sandwiched in between the backing layer 1 and abrasive layer 5 is foam layer 3. The three layers can be laminated together using a water resistant adhesive. The abrasive disc 19 can, for example, have a radius between about 0.25 and about 25 inches, for example, the radius of the disc can be about 1.5 inches, about 2.5 inches, and about 3 inches.

Foam layer 3 includes a dense porous material, and can be formed from various polymeric materials, such as polyurethane, polyester, synthetic or natural foam. Foam layer 3 can have a cell count between about 15 cells/cm and about 50 cells/cm, preferably about 25 cells/cm, and more preferably about 20 cells/cm. Cell count is measured as the number of cells along a linear unit of length; in this case, cells/cm. Average cell diameter can be between about 200 microns and about 650 microns. The density of foam layer 3 can be between about 30 kg/m$^3$ and about 80 kg/m$^3$, preferably about 50 kg/m$^3$, and more preferably about 55 kg/m$^3$. Foam layer 3 can absorb fluids, such as water and water mixtures, oil, and other fluid useful in abrasion processes. Compression load deflection, which indicates the firmness of the foam, can be between about 3 kPa to about 7 kPa at 40% deflection, preferably between about 4.5 kPa and about 6.5 kPa at 40% deflection, and more preferably about 5.5 kPa at 40% deflection. The thickness of foam layer 3 can range between about 5 mm and about 25 mm, preferably about 10 mm, and more preferably about 8 mm.

Backing layer 1 can be any support material, such as scrim, velour, velcro, felt, and other types of woven or non-woven fabrics. The backing layer 1 can be used as an attachment layer, which makes the abrasive disc attachable to powered tooling. Materials for backing layer 1 can include both natural and synthetic fibers, such as paper, polyester, polypropylene, polyethylene, nylon, rayon, steel, fiberglass, cotton, wool or a combination thereof. Alternatively, the backing layer can also he a film of a polymeric material. The backing can have a weight of about 30 to 120 g/m$^2$, preferably about 80 g/m$^2$. Backing layer 1 can also be a paper, plastic, composite or metal with a chemical or mechanical attachment such as pressure sensitive adhesive or a button attachment.

The backing can have a saturant, a presize layer or a backsize layer. The purpose of these layers typically is to seal the backing or to protect yarn or fibers in the backing. If the backing is a cloth material, at least one of these layers typically is used. The addition of the presize layer or backsize layer may additionally result in a "smoother" surface on either the front or the back side of the backing. Other optional layers known in the art can also be used (for example, a tie layer; see U.S. Pat. No. 5,700,302 of Stoetzel, et al., the entire contents of which are incorporated herein by reference).

The backing can include a fibrous reinforced thermoplastic such as described, for example, in U.S. Pat. No. 5,417,726 of Stout, et al., or an endless spliceless belt, as described, for example, in U.S. Pat. No. 5,573,619 of Benedict, et al., the entire contents of which are incorporated herein by reference. Likewise, the backing can include a polymeric substrate having hooking stems projecting therefrom such as that described, for example, in U.S. Pat. No. 5,505,747 of Chesley, et al., the entire contents of which are incorporated herein by reference. Similarly, the backing can include a loop fabric such as that described, for example, in U.S. Pat. No. 5,565,011 of Follett, et al., the entire contents of which are incorporated herein by reference.

Abrasive layer 5 is water impermeable and can include a support, abrasive grains, and one or more binders and/or coatings. For simplicity, the components of abrasive layer 5 are not shown in the drawings, but are described herein. The abrasive grains can, but need not, include abrasive agglomerate grains, also known as agglomerated abrasive grains. Abrasive agglomerate grains include abrasive particles adhered together by a particle binder material. The abrasive particles present in abrasive agglomerate grains can include one or more of the abrasives known for use in abrasive tools such as, for example, silica, alumina (fused or sintered), zirconia, zirconia/alumina oxides, silicon carbide, garnet, diamond, cubic boron nitride (CBN), silicon nitride, coria, titanium dioxide, titanium diboride, boron carbide, tin oxide, tungsten carbide, titanium carbide, iron oxide, chromia, flint, emery, and combinations thereof. The abrasive particles can be of any size or shape. The abrasive agglomerate grains can he adhered together by a particle binder material such as, for example, a metallic, organic, or vitreous material, or a combination of such materials. Examples of abrasive agglomerate grains suitable for use in the present invention are further described in U.S. Pat. No. 6,797,023, to Knapp, et al., the entire contents of which are incorporated herein by reference.

The abrasive grains can have one or more particular shapes. Example of such particular shapes include rods, triangles, pyramids, cones, solid spheres, hollow spheres and the like. Alternatively, the abrasive grains can be randomly shaped.

Typically, the abrasive grains have an average grain size not greater than 2000 microns, such as, for example, not greater than about 1500 microns. In another example, the abrasive grain size is not greater than about 750 microns, such as not greater than about 350 microns. In some embodiments, the abrasive grain size may be at least 0.1 microns, such as from about 0.1 microns to about 1500 microns, and, more typically, from about 0.1 microns to about 200 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

Examples of binder systems useful in binding the abrasive grains of abrasive layer 5 include epoxy resin, styrene butadiene resins, acrylic resins, phenolic resins or polyurethanes. The support material for binder layer 5 can include paper, cloth, rubber, polymer resin, or even metal, many of which are flexible. The binder layer can also include additional coatings over the abrasive grains, such as a size coat and a supersize coat.

Figure 2:
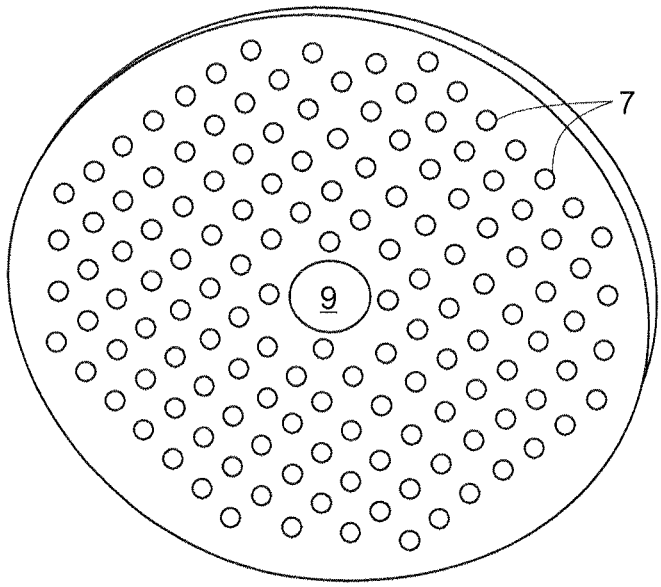
FIG. 2 represents an embodiment of the abrasive article of the invention.
Figure 3A:
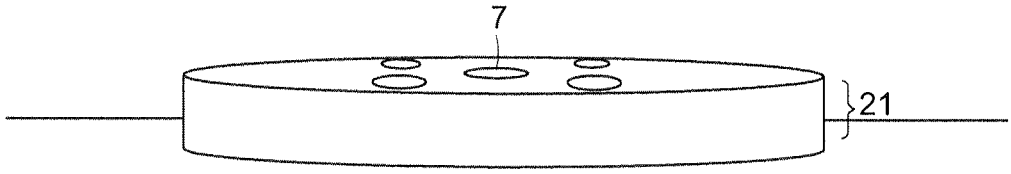
FIG. 3A is a view of an embodiment of the abrasive article of the invention on a surface prior to an abrasion cycle.

Perforations are formed in the abrasive discs of the present invention, establishing internal surfaces in the abrasive disc. The perforations are typically die-cut or cut using other methods such as laser or water jet. The die cutting can occur before or after lamination of the backing layer 1, foam layer 3, and abrasive layer 5. For example, the backing layer 1, foam layer 3, and abrasive layer 5 can be individually die cut, and then laminated together. Alternatively the layers are laminated together and then die cut. Backing layer 1 and foam layer 3 may or may not have perforations. The perforations can be arranged in any manner on the disc. In some embodiments, the perforations in the disc are positioned in a pattern. FIG. 2 shows an example of one embodiment that has a grid-like distribution of perforations 7 on the disc. The perforations can be any shape, such as circular, semi-circular, or polygonal. The perforations can also vary in size and shape, or be uniform in both size and shape. The perforations are preferably distributed over the surface of the disc. The disc shown in FIG. 2 also includes a large center hole 9 to facilitate attachment to a powered sanding device. In one embodiment, the perforations can be spaced apart by a length of about 5 mm and have an area of about 5 mm$^2$. In a preferred embodiment, the total area of the disc that is perforated is about 1.5% to about 50%, preferably about 6%. In addition to the first and second major surfaces, the abrasive disc has side surfaces 21, as shown in FIGS. 1 and 3A. Side surfaces 21 are exposed surfaces along the thickness of the abrasive disc, and are exposed at the outer sides of the disc and at the internal surfaces inside the perforations 7 of the disc. Thus, increasing the number and/or size of the perforations 7 increases the total surface area of side surfaces 21.

In use, the disc is at least partially saturated with a fluid, such as water. Any type of water-based fluid that easily flows into the foam of the disc, such as a thyxotropic solution, is a suitable fluid. Saturation of fluid into the disc can be achieved by placing the abrasive disc into a bucket of water or pouring water onto the abrasive disc. The foam absorbs and holds the water much like a reservoir. The disc can then be used manually, or attached to a powered device, such as a Dual Action (DA) sander and used for wet sanding. The abrasive disc shown in FIG. 3A has absorbed fluid and is placed on a work surface to be abraded.

Figure 3B:
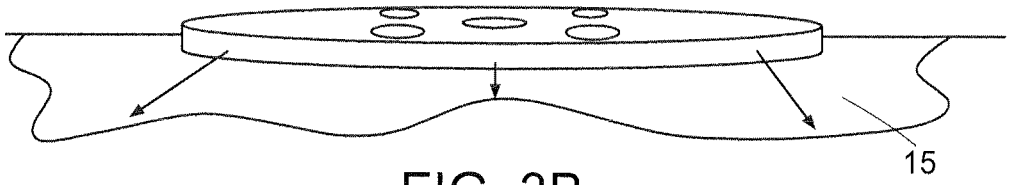
FIG. 3B is a view of an embodiment of the abrasive article of the invention on a surface during an abrasion cycle.

Referring to FIG. 3B, when pressure is applied to the disc (during an abrasion cycle) the fluid 15 is released from the foam layer of the abrasive disc. The fluid 15 exits onto the surface via side surfaces 21 of the foam layer at the outer sides of the disc and at the internal surfaces in the perforations 7 of the disc. The disc maintains a constant amount fluid at the point of contact between the abrasive disc and the work area. The perforations of the disc help to distribute the fluid to the surface and control fluid movement. Fluid is prevented from "running off," because much of it remains at the work surface within the perforations of the disc. During the abrasion cycle, the fluid 15 mixes with and absorbs work surface swarf that is generated during sanding, forming a fluid/swarf mixture 17.

Figure 3C:
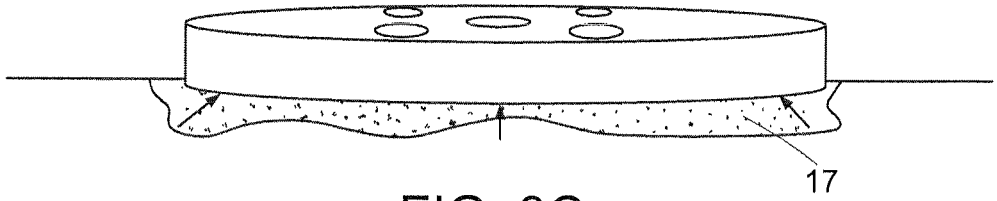
FIG. 3C is a view of an embodiment of the abrasive article of the invention on a surface after an abrasion cycle.

As shown in FIG. 3C, when compression on the disc is released, the foam absorbs the fluid/swarf mixture, trapping the swarf inside the pores of foam layer 3. The fluid can then be reused once again by applying pressure to the abrasive disc. Upon compression, the fluid again exits the abrasive disc via the side surfaces 21 at the outer sides of the disc and at the internal surfaces in the perforations 7 of the disc. The swarf, which is at least partially trapped within the open cell structure of the foam, remains in the abrasive disc, while the fluid is free to flow out of the disc for use in a second abrasion cycle. The cycle can be repeated until the abrasive layer is no longer usable (i.e., no longer capable of abrading the work surface).

EXAMPLE

Figure 4:
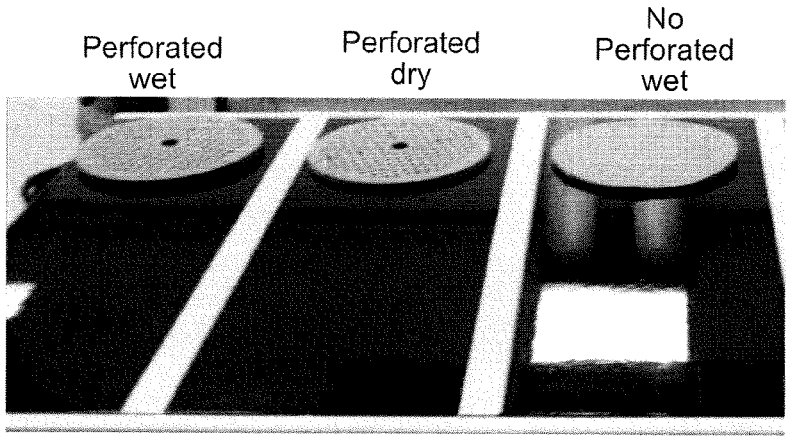
FIG. 4 is a photograph of the painted metal test panels and abrasive discs.

The following test was conducted to compare grinding performance of an abrasive disc of the present invention under both wet and dry grinding conditions. In addition, an abrasive disc having no perforations was also tested under wet conditions. The three discs were tested for abrasion performance in identical painted automobile-type metal panels prepared according to automobile standards. The test panels included a 50 cm by 20 cm test area. The discs and panels are shown in FIG. 4. The discs were mounted on a roto-orbital sander having a 2.4 mm orbit (Hutchins Model 3500), with Multi-Air back-up pads. The panels each were abraded for four cycles, each cycle being 5 seconds in duration.

The useful life of the product was determined by the number of abrasion cycles to form "pigtails" in the work surface. Pigtails are deep circular scratches in the work surface formed during abrasion. A higher number a cycles before observing pigtails indicates a longer useful life of the abrasive product. The visual appearance of the both the work surfaces and the discs were observed after each disc underwent four abrasion cycles. The results of test, shown below in Table 1, indicate that the perforated abrasive disc under wet conditions has a longer useful life than the same disc used dry. The wet perforated disc also had a longer useful life than the wet disc without perforations. This is also apparent from visual inspection of the work surface and abrasive surface after the abrasion cycles, which are also described in Table 1.

TABLE 1

Visual Appearance after 4 Cycles and Duration of Useful Product Life

| Disc/Sanding Type | # Cycles to Observe Pigtails | Visual Appearance of Work Surface | Visual Appearance of Discs (Swarf Contamination) |
|---|---|---|---|
| Perforated/Wet | 3 | Homogenous abrasion pattern | None |
| Perforated/Dry | 2 | Non-homogenous abrasion pattern, and deep scratches | Contamination present |
| Non-Perforated/ Wet | 1 | Non-homogenous abrasion pattern | Contamination present |

Surface roughness was evaluated using a M2 Nahr Perthometer (Ref. No. 6240252, Lt 5.600 mm, Ls 2.5 μm, Lc 0.800 mm). The average surface roughness and maximum surface roughness were measured after each 5-second abrasion cycle. The results are shown in FIGS. 5 and 6.

Figure 5:
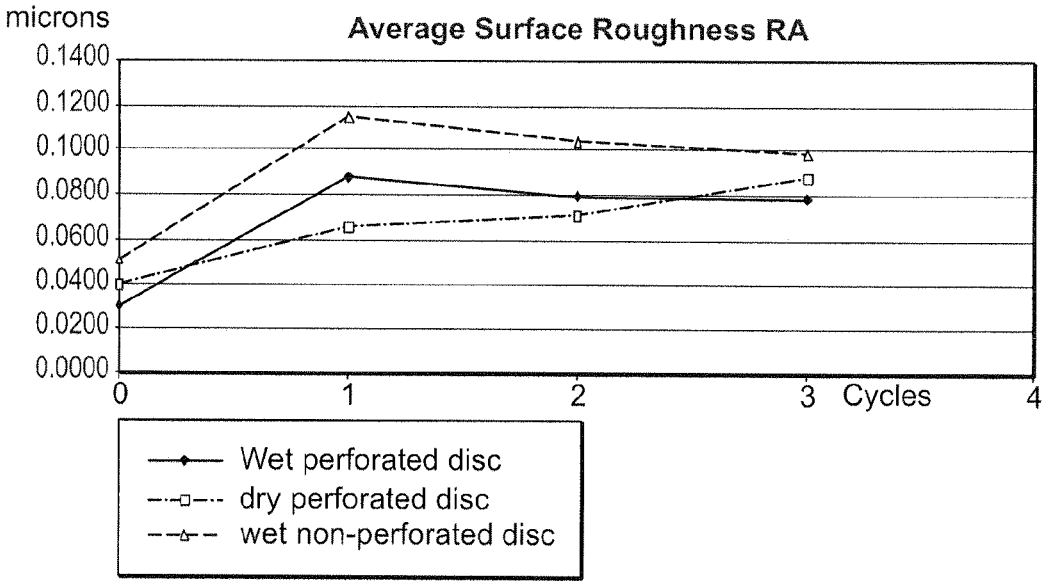
FIG. 5 is a graph of surface roughness average (Ra) during abrasion.
Figure 6:
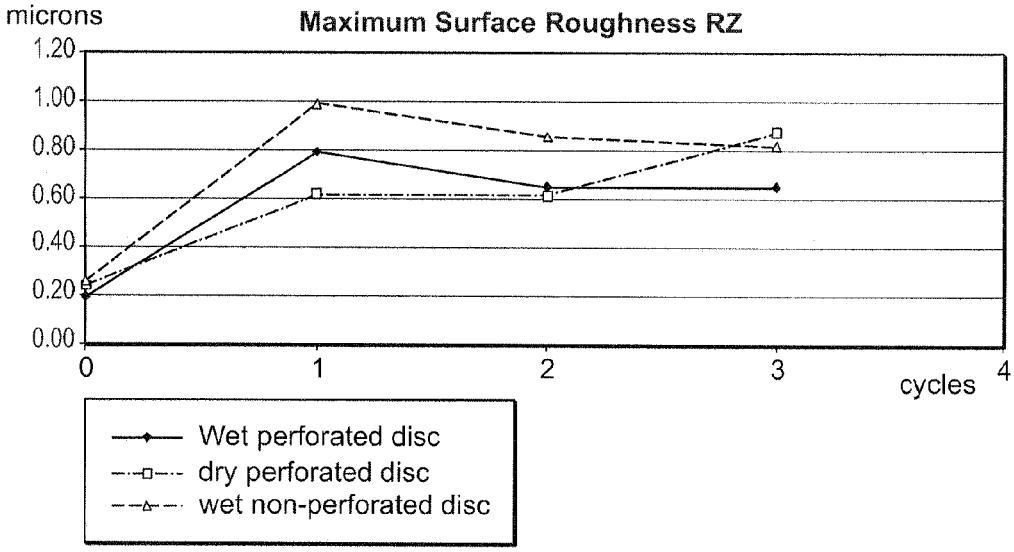
FIG. 6 is a graph of maximum surface roughness (Rz) during abrasion.

FIG. 5 indicates that the non-perforated disc used in wet abrasion generates deeper scratches during each cycle in comparison to the perforated disc used in wet abrasion. Ra. is the average roughness of a surface. It describes average the height/depth of peaks and valleys in an uneven surface. For both wet discs, the average surface roughness Ra decreases over the number of abrasion cycles. In contrast, the dry perforated disc caused increased average surface roughness over each cycle. FIG. 6 shows maximum surface roughness Rz. Rz is the average height difference between the 5 highest peaks and 5 lowest valleys along a length of surface being measured.

Figure 7:
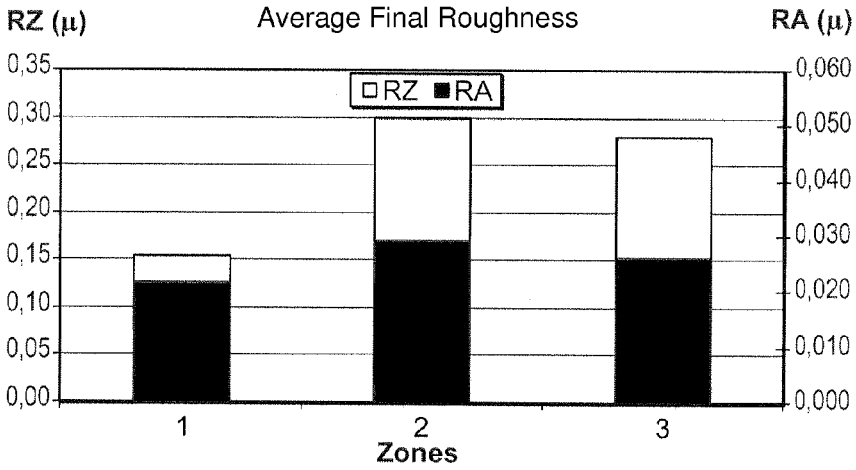
FIG. 7 is a graph of the average surface roughness average (Ra) and maximum surface roughness (Rz) after polishing.

Each of the surfaces were polished using identical polishing material: Norton One Step Liquid Ice Polish (available from the Norton Company) on a foam of medium density. The polishing cycle was 20 seconds. FIG. 7 shows the results of the surface roughness for each of the three test panels after polishing. The wet perforated disc (zone 1) provided a better finish in comparison to the wet non-perforated disc (zone 3) and the dry perforated disc (zone 2). The dry perforated disc created deep scratches that could not be removed by polishing. The scratches caused by the wet non-perforated disc were removable, after polishing for more than the 20-second test cycle.

While this invention has been particularly shown and described with references to example embodiments thereof, it will be understood by those skilled in the art that various changes in form and details may be made therein without departing from the scope of the invention encompassed by the appended claims. The teachings of all patents, published applications and references cited herein are incorporated by reference in their entirety.

What is claimed is:

1. An abrasive disc comprising a backing layer at a first major surface, an abrasive layer at a second major surface, and a water-absorbable, compressible, resilient, porous foam layer sandwiched in between the backing layer and the abrasive layer, the disc further including a plurality of perforations in the abrasive layer and in the foam layer, wherein the foam layer has a cell count between about 15 cells/cm and 50 cells/cm, and a density between about 30 kg/m$^3$ and 80 kg/m$^3$.

2. The abrasive disc of claim 1, wherein the foam layer comprises polyurethane.

3. The abrasive disc of claim 1, wherein the water-absorbable foam layer has a thickness between about 5 mm and about 25 mm.

4. The abrasive disc of claim 1, having a radius between about 0.25 inches and about 25 inches.

5. The abrasive disc of claim 1, wherein individual perforations of the plurality of perforations have an area of about 5 mm$^2$.

6. The abrasive disc of claim 1, wherein the surface area of the disc is between about 1.5% and about 50% perforated.

7. The abrasive disc of claim 1, wherein the plurality of perforations are spaced apart from one another by a distance of about 5 mm.

* * * * *